US006311030B1

(12) United States Patent
Terada

(10) Patent No.: US 6,311,030 B1
(45) Date of Patent: Oct. 30, 2001

(54) CHARGING DEVICE IN WHICH CHARGING MEMBER IS CONTACTABLE WITH AND SEPARABLE FROM CHARGED MEMBER

(75) Inventor: Ichiro Terada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,493

(22) Filed: Feb. 23, 2000

(30) Foreign Application Priority Data

Feb. 26, 1999 (JP) ..... 11-050709

(51) Int. Cl.[7] ..... G03G 15/00
(52) U.S. Cl. ..... 399/90; 399/89
(58) Field of Search ..... 399/50, 88, 89, 399/90, 115, 168, 111, 174; 361/221, 225, 236

(56) References Cited

U.S. PATENT DOCUMENTS 4,305,651 * 12/1981 Umezawa et al. ..... 399/89
5,095,335 3/1992 Watanabe, et al. ..... 399/111
5,426,488 * 6/1995 Hayakawa et al. ..... 399/174
5,749,022 * 5/1998 Kikui et al. ..... 399/50
5,870,655 * 2/1999 Nishiuwatoko et al. ..... 399/111

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

A charging device for charging a charged member includes a charging member for contacting the charged member to charge the charged member. A contact-separation device is provided for contacting/separating the charging member to/from the charged member. A power supply device supplies power to the charging member, in which a power supply path can be opened. The power supply device is constituted so that when the charging member contacts the charged member, the power supply path is closed, and when the charging member is separated from the charged member, the power supply path is opened.

8 Claims, 11 Drawing Sheets

FIRST STATE
(PRESSURE CONTACT)

SECOND STATE (NON-CONTACT)

CHARGING DEVICE IN WHICH CHARGING MEMBER IS CONTACTABLE WITH AND SEPARABLE FROM CHARGED MEMBER

BACKGROUND OF THE INVENTION

1. Field of the Invention

The present invention relates to a contact type charging device, particularly to a charging device suitable for image forming apparatuses such as a copying machine and a printer.

2. Related Background Art

In an image forming apparatus using an electrophotographic system, or an electrostatic recording system, a charging device is used for charging image bearing members such as a photosensitive member.

This image forming apparatus usually has the following means constitution and image forming process. Specifically, the process comprises: using the electrophotographic photosensitive member usually of a rotary drum type as the image bearing member, such as selenium, cadmium sulfide, zinc oxide, amorphous silicon, and organic photoconductor; uniformly charging the surface of the photosensitive member to provide a predetermined polarity and potential by charging means; exposing an image on the surface of the charged photosensitive member by image exposure means to form an electrostatic latent image in accordance with the exposed image; attaching a developer toner to the electrostatic latent image by developing means to develop a toner image; and transferring the toner image to a transfer material. The transfer material with the toner image transferred thereon is subjected to a fixing processing by fixing means and discharged as an image forming material (copy, print). Moreover, after the toner image is transferred to the transfer material, the untransferred residual toner is removed from the rotating photosensitive member by cleaning means (cleaner), and the photosensitive member is cleaned and repeatedly used for the image formation.

As the charging means of the photosensitive member as the image bearing member which is a charged member, the charging means of a "corona charging system" using a corona discharge unit has heretofore been used, but in recent years, a "contact charging system (direct charging system)" has been used because the system has advantages such as lower ozone and lower power as compared with the corona charging system.

The contact charging system uses no corona charging, and comprises: placing a conductive member with an adjusted resistance value as the charging member into contact with the photosensitive member as the charged member; applying a voltage (charging bias) to the charging member; and charging the surface of the photosensitive member to provide a predetermined polarity or potential.

As the charging member, in addition to a conductive elastic roller type (charging roller), a conductive elastic blade type (charging blade), a magnetic brush type (magnetic brush member), a fur brush type (fur brush member), and other various types are used.

As compared with the corona charging system, the contact charging system can lower the applied voltage, remarkably reduces the amount of corona products such as ozone, and has other advantages such as a good power efficiency.

In the contact charging system, however, when the charging member is left in contact with the charged member for a long period, the pressure contact surface has a local fatigue deformation.

The charging member is always urged onto the charged member surface by an urging member and its own weight. When the device is left as it is for a long period (e.g., one year or longer) without moving/driving the surface of the charged member, the charging member portion urged onto the charged member surface causes an irreversible deformation (fatigue deformation).

Once such deformation occurs, a charging defect is generated in the portion, and a normal image cannot be obtained.

Moreover, when the sufficient nip width of the charging member and the charged member is obtained to provide a higher charging property, the hardness of the charging member needs to be lowered. Conversely, when the hardness is lowered, the fatigue deformation easily occurs. Even when the period in which no surface moving/driving is performed is not very long, the above-described problem easily arises.

To solve the problem, it is proposed in U.S. Pat. No. 5,095,335 that a charging roller be contacted to or separated from a photosensitive member in association with the mounting/dismounting operation of a process cartridge to an apparatus main body.

Thereby, even when the process cartridge is stored for a long period, the charging roller cannot be deformed.

The contact/separation of the charging roller to/from the photosensitive member is effective for preventing the charging roller from being deformed, but if the charging roller does not exactly contact the photosensitive member, a charging defect is generated.

SUMMARY OF THE INVENTION

An object of the present invention is to provide a charging device in which when a charging member is separated from a charged member, no voltage is applied to the charging member.

Another object of the present invention is to provide a charging device which can check the conductive state of a power supply path.

Further object of the present invention is to provide a charging device which includes: a charging member for contacting a charged member and charging the charged member; contacting/separating means for contacting/separating the charging member to/from the charged member; and power supply means for supplying power to the charging member and provided with an openable power supply path. When the charging member contacts the charged member, the power supply path of the power supply means is closed. When the charging member is separated from the charged member, the power supply path is opened.

Still further objects of the present invention will be apparent in the following description.

DETAILED DESCRIPTION OF THE PREFERRED EMBODIMENTS

Embodiments of the present invention will be described hereinafter with reference to the drawings.

Figure 1:
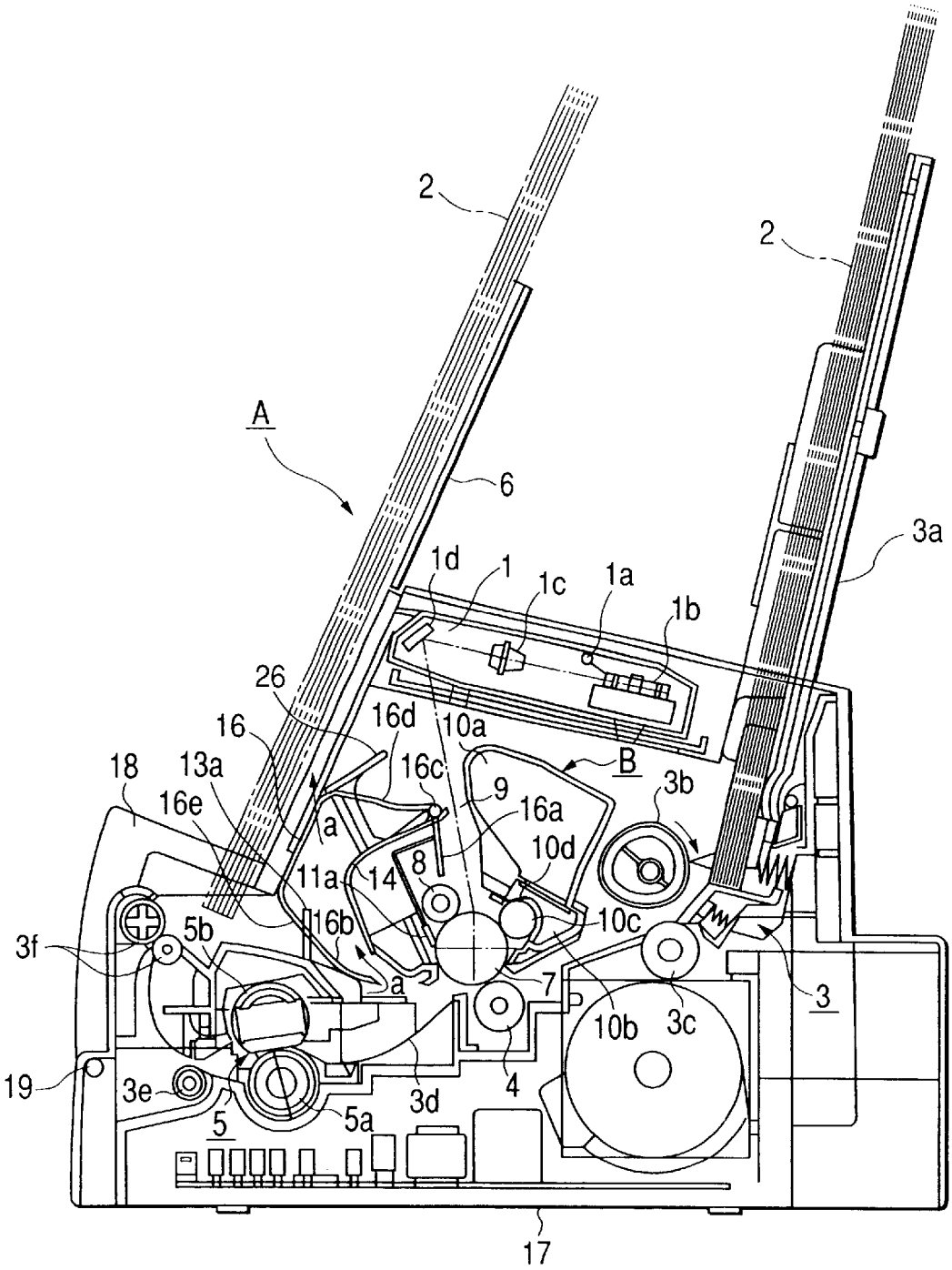
FIG. 1 As a schematic view showing the example of an image forming apparatus (laser beam printer).

FIG. 1 is a schematic view of an image forming apparatus A using a charging device according to an embodiment. The image forming apparatus A of the present embodiment is a laser beam printer utilizing a transfer type electrophotographic process, a roller charging system (contact charging using a charging roller), and a process cartridge system.

Figure 2:
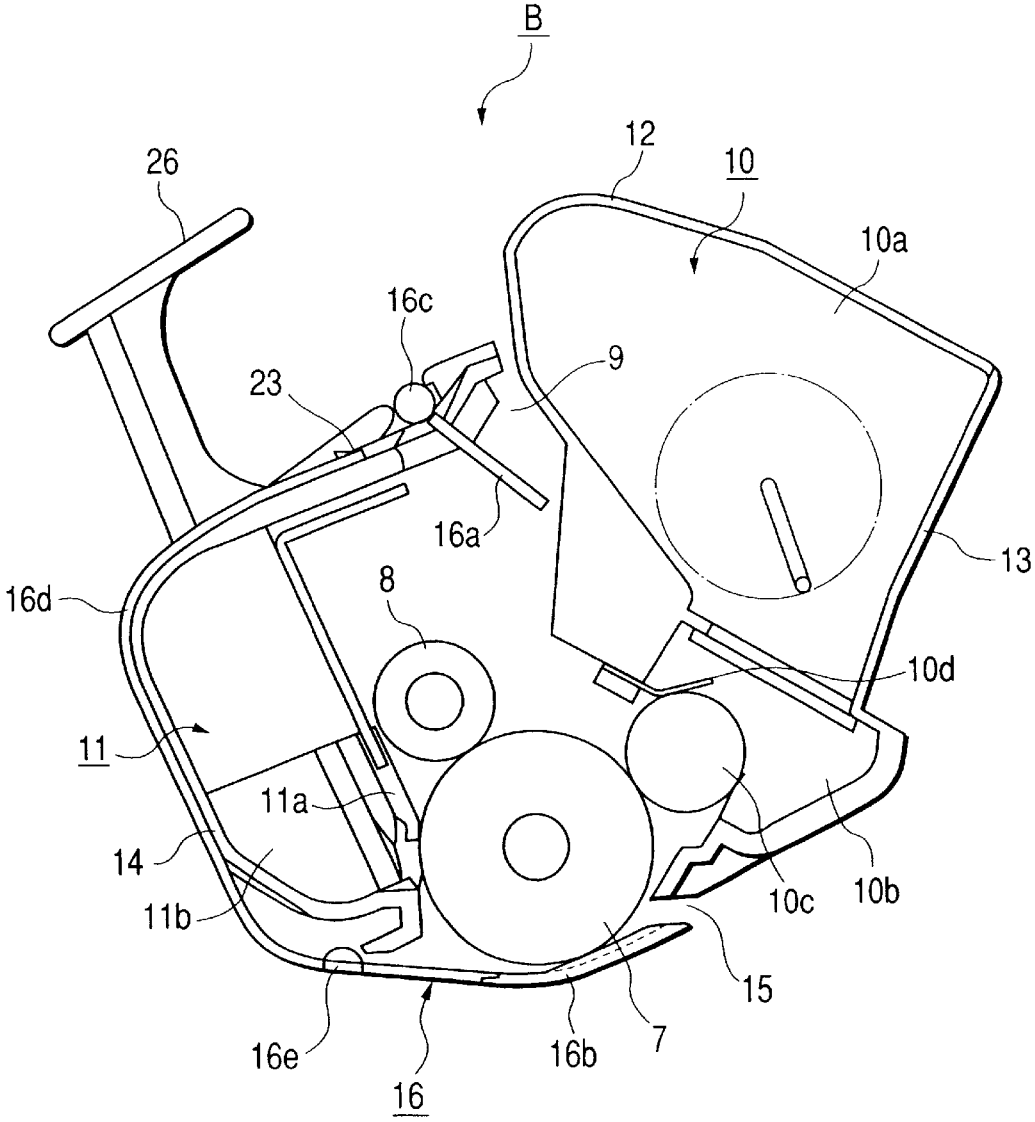
FIG. 2 is an enlarged transverse sectional view of a process cartridge.
Figure 3:
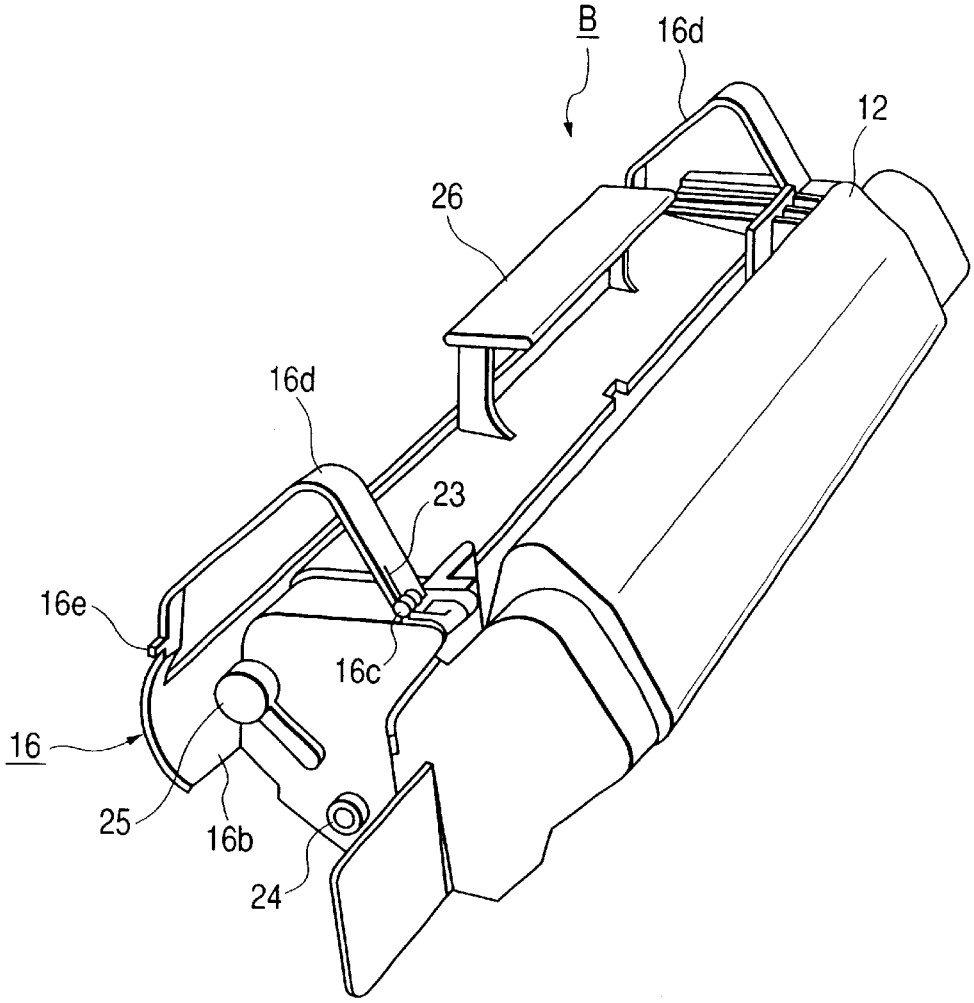
FIG. 3 is an perspective view of the process cartridge (when a shutter is in an opened state).
Figure 4:
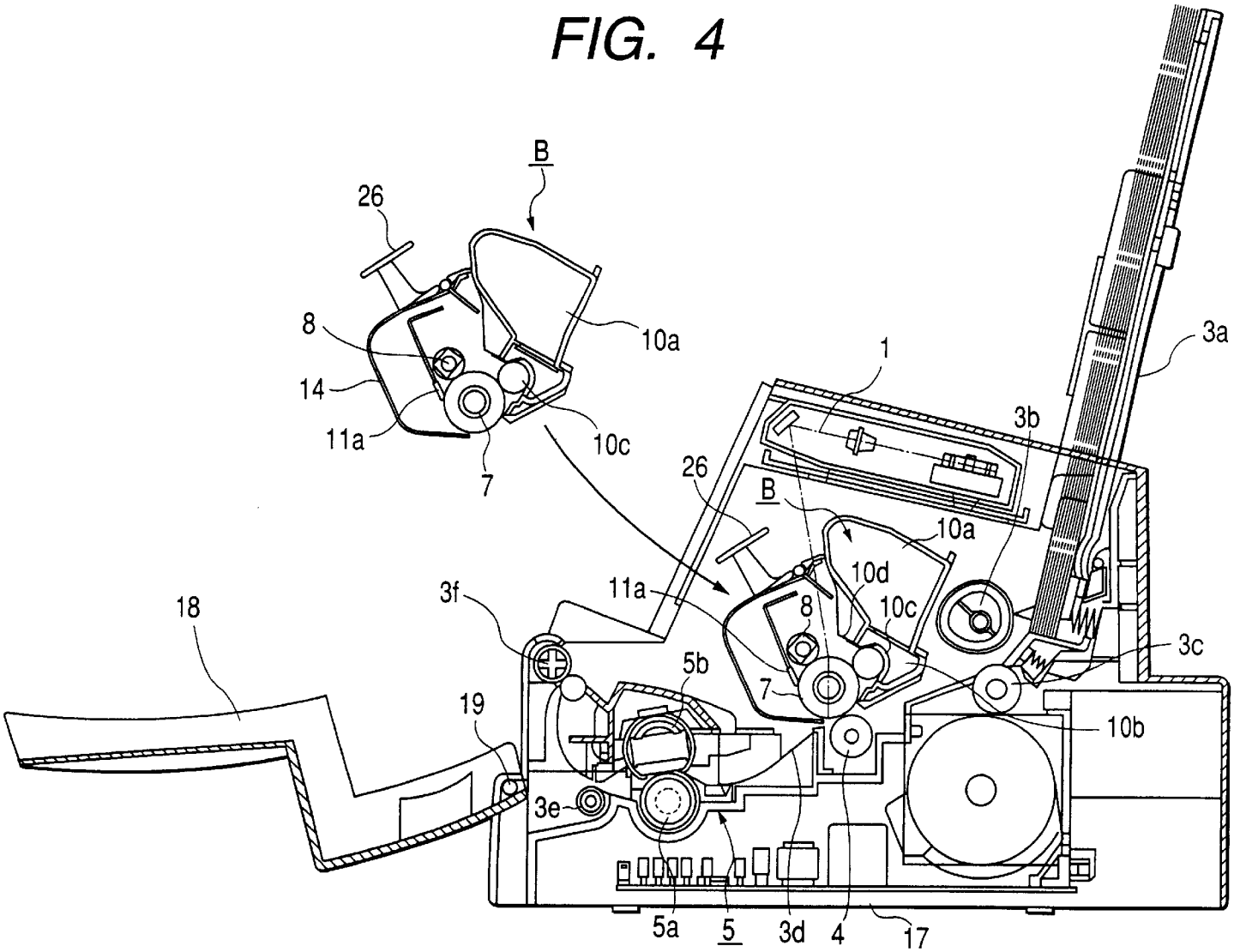
FIG. 4 is an explanatory view showing an mounting/dismounting procedure of the process cartridge with respect o a printer main body.

FIG. 2 is an enlarged transverse sectional view of a process cartridge B, FIG. 3 is an perspective view of the process cartridge B, and FIG. 4 is an explanatory view showing the mounting/dismounting procedure of the process cartridge B with respect to a main body of the printer.

(1) Printer Main Body And Process Cartridge

This printer main body A forms an image on a recording material by the transfer type electrophotographic process. Specifically, in FIG. 1, a toner image is formed on a drum-shaped electrophotographic photosensitive member (hereinafter referred to as the photosensitive drum) 7 as the image bearing member. In synchronization with the formation of the toner image, a recording material 2 set on a feed tray 3*a* is conveyed by conveying means 3 constituted of a pickup roller 3*b* and a conveying roller 3*c*. Subsequently, the toner image formed on the photosensitive drum 7 of the process cartridge B is transferred to the recording material 2 by applying a voltage to a transfer roller 4 as transfer means. Thereafter, the recording material 2 with the toner image transferred thereto is conveyed to fixing means 5 via a guide 3*d*. The fixing means 5 is constituted of a drive roller 5*a* and a fixing roller 5*b* incorporating a heater, and the transferred toner image is fixed by applying heat and pressure to the passing recording material 2. Subsequently, the recording material 2 is surface-reverse-conveyed by discharge rollers 3*e*, 3*f* and discharged to a discharge tray 6.

For the process cartridge B, as shown in FIGS. 1, 2, the photosensitive drum 7 having a photosensitive layer as the image bearing member is rotated, and the drum surface is uniformly charged by applying the voltage to a charging roller 8 as contact charging means. Subsequently, a laser beam from an optical system 1 is radiated to the photosensitive drum 7 via an exposure opening 9 in accordance with image information to form a latent image. Subsequently, the latent image is developed using toner by developing means 10.

The charging roller 8 is disposed in contact with the photosensitive drum 7 to charge the photosensitive drum 7. Moreover, the developing means 10 supplies the toner to the developing area of the photosensitive drum 7 to develop the latent image formed on the photosensitive drum 7. Additionally, the optical system 1 has a laser diode 1*a*, a polygon mirror 1*b*, a lens 1*c*, and a reflective mirror 1*d*.

The developing means 10 supplies the toner in a toner chamber 10*a* to a development chamber 10*b*, rotating a developing roller 10*c* attached to the development chamber 10*b*, forming a toner layer with an triboelectrification charge applied thereto by a developing blade 10*d* on the surface of the developing roller 10*c* incorporating a stationary magnet, and supplies the toner to the developing area of the photosensitive drum 7. Subsequently, by transferring the toner to the photosensitive drum 7 in accordance with the latent image, the toner image is formed and visualized.

After the toner image formed on the photosensitive drum 7 is transferred to the recording material 2 by applying the voltage with a polarity opposite to that of the toner image to the transfer roller 4, the residual toner on the photosensitive drum 7 is removed by cleaning means 11. Here, the cleaning means 11 scrapes off the toner remaining on the photosensitive drum 7 by an elastic cleaning blade 11*a* and collects the toner into a waste toner reservoir 11*b*.

The components of the photosensitive drum 7 are stored in a cartridge frame constituted by combining a toner development frame 12, a toner development wall member 13, and a cleaning frame 14 so that a cartridge is formed. Specifically, the toner development frame 12 and toner development wall member 13 are welded to constitute the toner chamber 10*a* and development chamber 10*b*, and the developing roller 10*c* and developing blade 10*d* are attached to the development chamber 10*b*. Moreover, the members constituting the photosensitive drum 7, charging roller 8, and cleaning means 11 are attached to the cleaning frame 14. Furthermore, the process cartridge B is constituted by swingably combining the toner development frame 12 and the cleaning frame 14.

This process cartridge B is provided with the exposure opening 9 for irradiating the photosensitive drum 7 with light in accordance with the image information and a transfer opening 15 for disposing the photosensitive drum 7 opposite to the recording material 2. Moreover, a shutter member 16 is attached such that both the openings 9, 15 can be opened and closed. Specifically, the transfer opening 15 is disposed to transfer the toner image formed on the photosensitive drum 7 to the recording material 2.

As shown in FIG. 4, in the printer A, an openable/closable cover 18 is rotatably attached to a printer main body 17 so as to be rotatable about a shaft 19. Moreover, when the openable/closable cover 18 is opened, a guide member (rail groove, not shown) for guiding the process cartridge B is disposed inside the printer main body 17. Furthermore, an operator mounts and dismounts the process cartridge B along the guide member. In this case, as shown in FIG. 3, a first protrusion 24 and a second protrusion 25 disposed on the end wall of the process cartridge B in a longitudinal direction are guided along the guide member (not shown) of the printer main body 17.

As shown in FIGS. 2, 3, the shutter member 16 has a first shutter member 16*a* fixed to a rotatably supported rotary support 16*c*, and a second shutter member 16*b* supported by arms 16*d*. The first shutter member 16*a* is urged to close the exposure opening 9, and the second shutter member 16*b* is urged to close the transfer opening 15 by a spring force of a torsional coil spring 23 attached to the rotary support 16*c*. When the process cartridge B is outside the printer main body 17, the first shutter member 16*a*, and the second shutter member 16*b* close the exposure opening 9, and the transfer opening 15, respectively (FIG. 2).

When a grip member 26 integrally formed with the cleaning frame 14 is gripped to mount the process cartridge B to the printer main body 17, an engaging protrusion 16*e* protruding outwardly in the longitudinal direction of the distal end of the arm member 16*d* for supporting the second shutter member 16*b* to cover the photosensitive drum 7 abuts against the printer main body 17, so that the further advancing into the cartridge mounting section is stopped. In this state, the first and the second protrusions 24, 25 of the process cartridge B advances along the guide member (not shown) of the printer main body 17, and the shutter member 16 reaches a position to open the exposure opening 9, and the transfer opening 15 (FIGS. 1, 3). When the process cartridge B is dismounted from the printer main body 17, the shutter member 16 closes the exposure opening 9 and the transfer opening 15 by the spring force of the torsional coil spring 23 (FIG. 2).

(2) Operation Process Diagram of Printer

Figure 5:
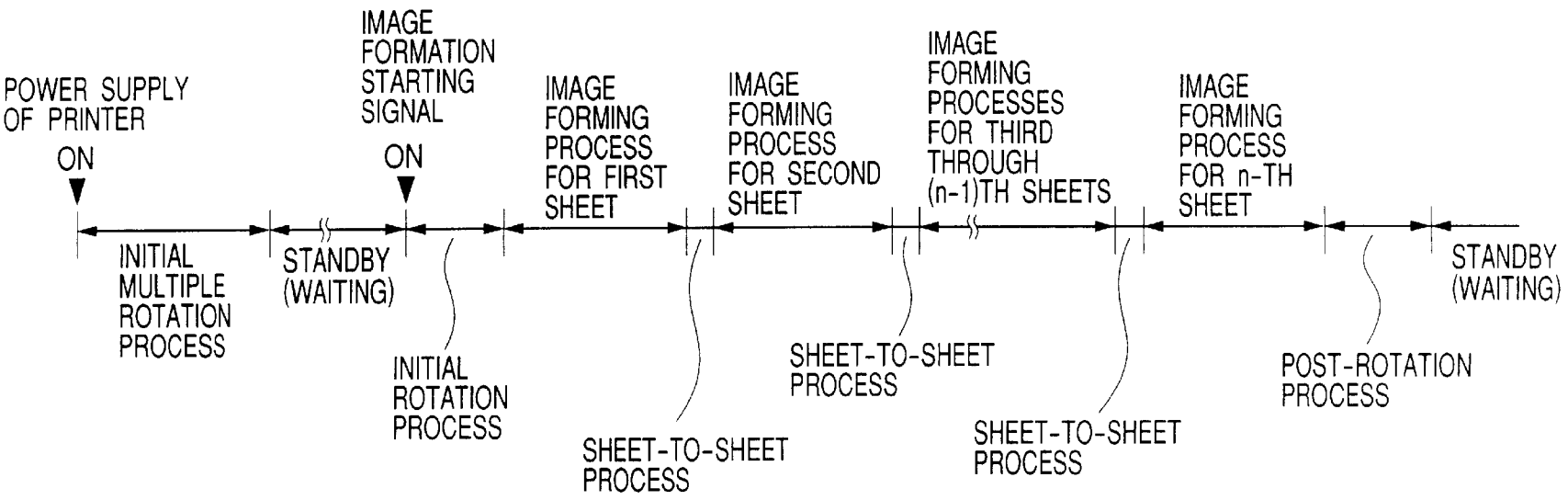
FIG. 5 is an operation process diagram of the printer.

FIG. 5 is an operation process diagram of the printer A in the present embodiment.

a) Initial Multiple Rotation Process

This is a printer starting (activating) operation period (warming period). By turning on the main power switch, a main motor (not shown) of the printer is driven to rotate/drive the photosensitive drum 7, and a required process apparatus preparing operation is performed.

b) Standby

After the predetermined starting period ends, the drive of the main motor is once stopped to stop the rotating/driving of the photosensitive drum, and the printer is held in a standby (waiting) state until an image formation (printing) starting signal is inputted.

c) Initial Rotation Process

In response to the input of the image formation starting signal, the main motor is restarted to rotate/drive the photosensitive drum 7 again, and the printer performs a predetermined image forming initial operation for a while in this period.

d) Image Forming Process

When the predetermined initial rotation process ends, the image forming process is performed on the rotating photosensitive drum 7, the recording material 2 with the toner image transferred thereto is conveyed to the fixing means 5, and the image forming process for a first sheet is performed.

In a continuous image formation mode, the above-described image forming process is repeated and the image forming process for a predetermined number n of sheets is successively performed.

e) Sheet-to-sheet Process

In the continuous image formation mode, this is a period in which no recording material is passed through the transfer section T after a trailing end of a preceding recording material 2 passes through the transfer section and before a leading end of a succeeding recording material 2 reaches the transfer section T.

f) Post-Rotation Process

Even after the image forming process for the final n-th sheet ends, the drive of the main motor is continued for a while to rotate/drive the photosensitive drum 7, and the printer performs a predetermined post-operation in this period.

g) Standby

When the predetermined post-rotation process ends, the drive of the main motor is stopped to stop the rotating/driving of the photosensitive drum 7, and the printer is again held in the standby state until the next image formation starting signal is inputted.

When the image formation starting signal is inputted immediately after the initial multiple rotation process, the image forming process is subsequently performed after the initial rotation process. Moreover, in the image formation only for one sheet, after the image forming process ends, the printer is subjected to the post-rotation process and placed in the standby state.

In the above, the image forming process of the item d) corresponds to an image forming process period, and the initial multiple rotation process of the item a), the initial rotation process of the item c), the sheet-to-sheet process of the item e), and the post-rotation process of the item f) correspond to a nonimage forming process period.

(3) Charging Roller 8

Figure 6:
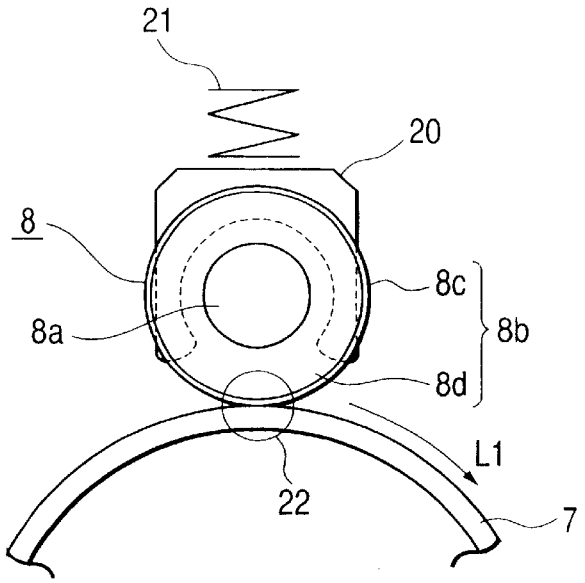
FIG. 6 is an enlarged transverse sectional view of a charging roller.

The charging roller 8 will next be described. As shown in FIG. 6, the charging roller 8 has a structure in which a core metal (conductive base) 8*a* mainly formed from SUS is surrounded with a resistance layer 8*b*. The resistance layer 8*b* has a covering layer 8*c* as a surface layer, and an elastic layer 8*d* as an underlying layer.

The charging roller 8 abuts on the photosensitive drum 7 via a bearing 20 formed from a conductive member by an urging member 21 such as a coil spring to constitute an electric circuit. Moreover, power is supplied to the charging roller 8 from the power source (not shown) via the bearing 20, the charging is performed via a nip portion 22 with the photosensitive drum 7, and the surface of the photosensitive drum 7 is uniformly charged as the surface of the photosensitive drum 7 moves in a direction indicated by the arrow L1.

(4) Cleaner-less System

Figure 7:
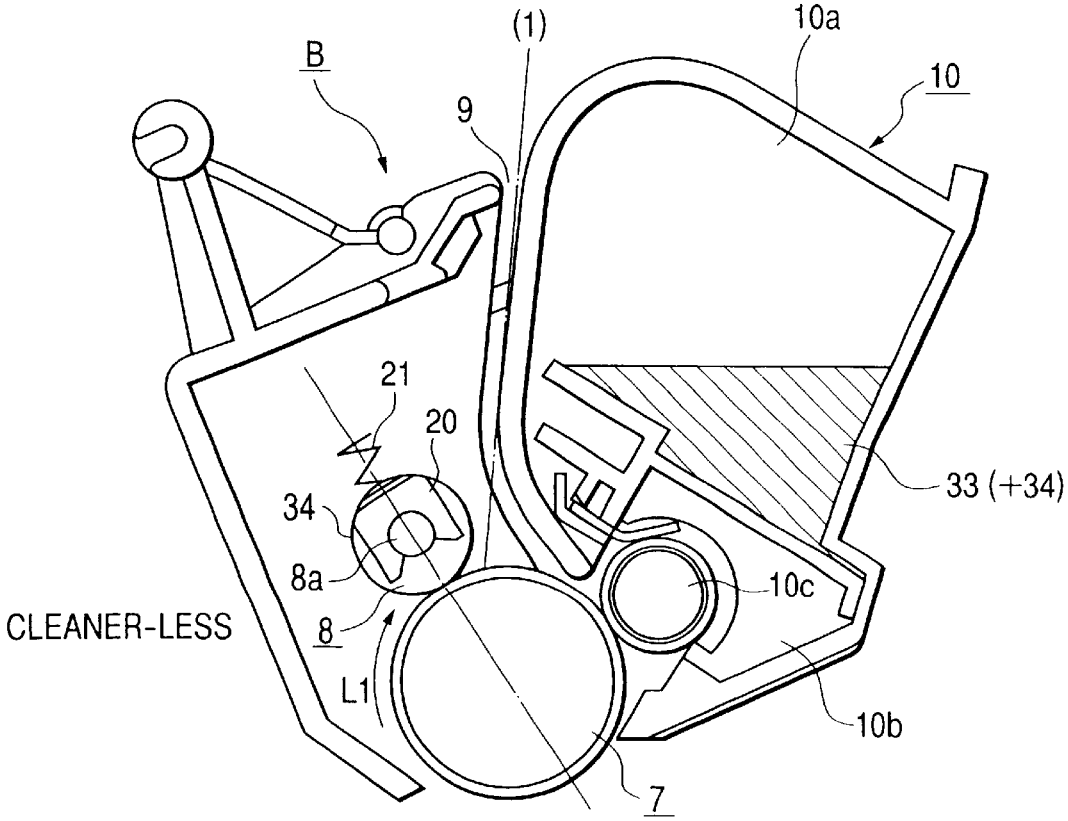
FIG. 7 is a transverse sectional view of the cleaner-less process cartridge.

A cleaner-less system will next be described with reference to FIG. 7. The process cartridge B of FIG. 7 is of the cleaner-less system, and is not provided with dedicated cleaning means 11 for removing the untransferred residual toner from the surface of the photosensitive drum 7 after the transfer of the toner image onto the recording material 2. Moreover, the charging device for use herein is constituted of the charging roller 8 mainly using the conductive elastic member and charging accelerator particles 34 such as zinc oxide and titanium oxide for the purpose of charging acceleration.

The charging accelerator particles 34 are applied beforehand to the surface of the charging roller 8 to provide a satisfactory charging state from the beginning. Moreover, in this system, to stably supply the charging accelerator particles 34 to the charging roller 8 in the initial and subsequent stages, charging accelerator particle supply means (not shown) is disposed, or the charging accelerator particles 34 are mixed into toner 33 in the toner chamber 10*a*.

Particularly when the charging accelerator particles 34 are used for charging the photosensitive member, not to hinder the image exposure, colorless or substantially white particles are appropriate. The particle diameter is preferably equal to or less than the size of the constituting pixel in order to prevent light scattering from being caused by the particles during the image exposure.

Furthermore, the material of the charging roller 8 used herein is a foamed elastic material (trade name: Rubycell) formed from foaming urethane resin with carbon black dispersed therein to adjust the resistance. Moreover, besides Rubycell, there are foamed rubber materials or resins in which carbon black, metal oxide, ion conductive agent, and the like are dispersed in EPDM, urethane, NBR, silicon rubber, IR, and the like to adjust the resistance.

A direct voltage of −700 V is applied to the charging roller core metal 8*a*, and the surface of the photosensitive drum 7 is charged to provide substantially the same potential as that of the applied voltage. Thereafter, the image section is scanned with the laser diode 1*a* of the optical system 1 in accordance with the print pattern to form the electrostatic latent image on the photosensitive drum 7. Subsequently, the electrostatic latent image on the photosensitive drum 7 is visualized by the toner 33 subjected to the triboelectrification charging. The developed toner image on the photosensitive drum 7 is finally transferred to the recording material 2, and the recorded image is obtained by the fixing means 5. To recycle the toner, the untransferred residual toner on the photosensitive drum 7 is agitated and mixed to the charging roller 8 by micro protrusions on the surface of the charging roller 8, and the charging accelerator particles are also collected and held in the charging roller 8, so that the charging roller 8 can hold the close contact property and contact resistance with respect to the photosensitive drum 7, and direct charging (charge injection charging) is enabled. Moreover, since the protrusions on the surface of the charging roller and charging accelerator particles closely contact the photosensitive drum 7 to perform the charging, the satisfactory image forming apparatus can be provided without image or charging defects such as ghost by the untransferred residual toner passed through the charging member.

Subsequently, the toner 33 mixed in the charging roller 8 is gradually exhaled from the charging roller 8 and collected or developed again by the developing means 10 (developing simultaneous with collecting).

The developing simultaneous with collecting (or developing simultaneous with cleaning) method comprises: successively charging the photosensitive drum during the developing on and after the next process; performing the exposure to form the latent image; and collecting the toner remaining on the photosensitive drum after the transfer by a fog removal bias (a fog removal potential difference Vback which is a potential difference between the direct-current voltage applied to the developing device and the surface potential of the photosensitive member) during the developing of the latent image. According to this method, since the untransferred residual toner is collected by the developing device and reused on and after the next process, waste toner is eliminated, and troublesome maintenance can be reduced. Moreover, in the cleaner-less system, great advantages are given to a space respect, and the image forming apparatus can be miniaturized.

By repeating the above-described processes, the toner recycling is enabled, while the direct charging is performed, and this situation can be maintained for a long period, so that the cleaner-less system can be realized.

Moreover, preferably as the constitution of the charging device described above, the charging roller 8 is rotated/driven or fixed to obtain a peripheral speed difference from the photosensitive drum 7, the charging roller 8 is rotated/driven to temporarily collect and even the untransferred residual toner, and further the charging roller 8 is rotated in a direction opposite to the moving direction of the surface of the photosensitive member surface.

(5) Pressurizing/Pressure Release Mechanism of Charging Roller 8

Figure 8:
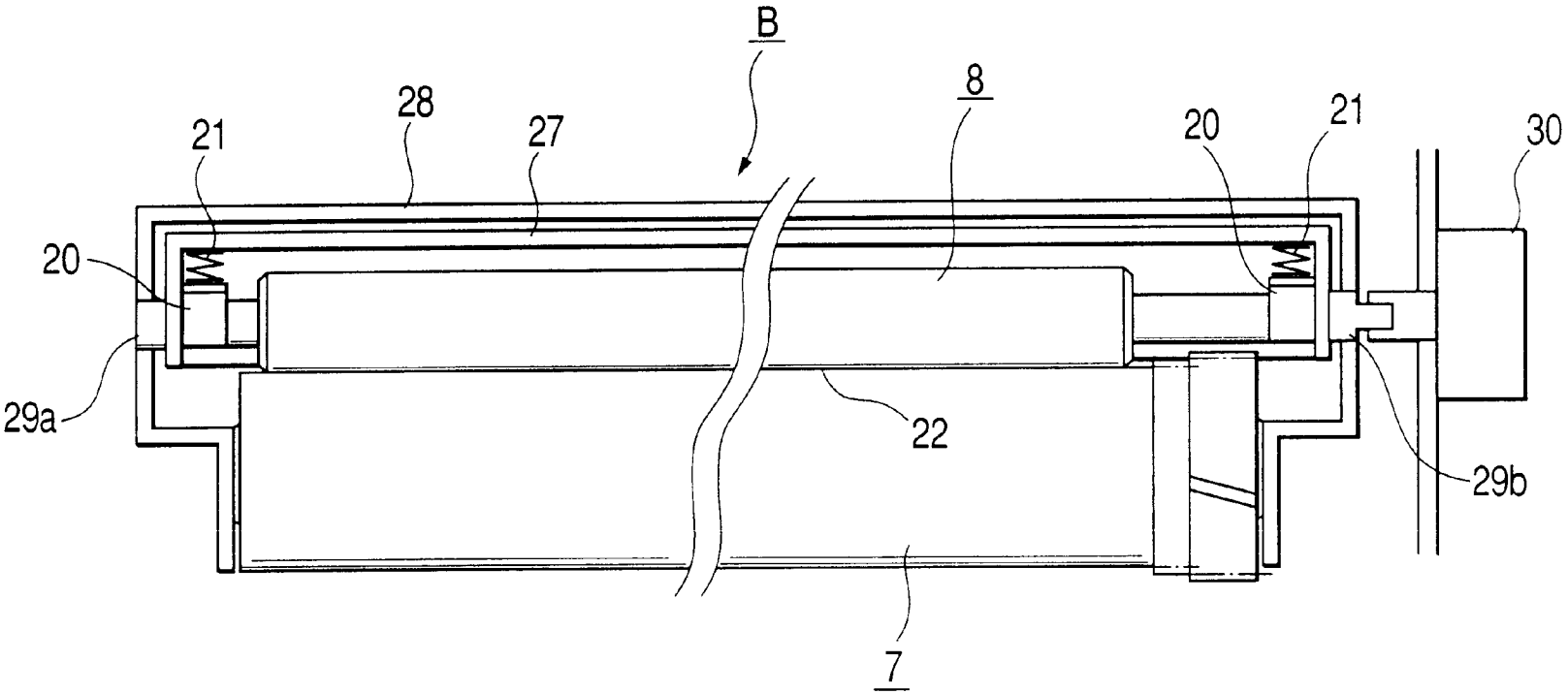
FIG. 8 is a vertical sectional view of the process cartridge.

FIG. 8 is a transverse sectional view of the process cartridge B. A holding member 27 has bosses 29*a*, 29*b* outside of its longitudinal direction, and is disposed in the vicinity on the coaxial line of the charging roller 8 during the image formation. Since the bosses are snap-fitted to the wall surface of a cartridge frame 28, the holding member 27 is rotatably supported. Moreover, since one boss 29*b* has a coupling shape, during insertion of the process cartridge B to the printer main body 17, the boss is engaged with the coupling portion of drive means 30 on the side of the printer main body 17 so that drive transmission is enabled. Additionally, the drive means 30 is not limited to a motor unit, and may be branched from the main motor of the main body via a gear train.

Figure 9:
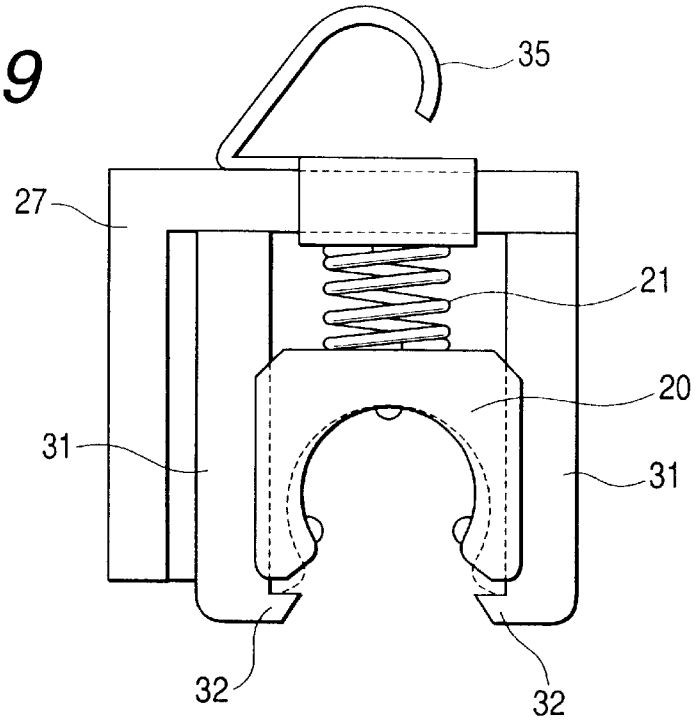
FIG. 9 is a view showing a bearing portion of the charging roller.

In FIG. 9, the holding member 27 has a bearing guide 31 inside in the longitudinal direction, and the bearing 20 is inserted into the bearing guide 31 so that the bearing 20 is attached to the holding member 27 and can move along the bearing guide 31.

Moreover, a stopper 32 prevents the bearing 20 from dropping from the bearing guide 31 by the urging force of the urging member 21.

Since the holding member 27 is supported in the cartridge frame 28 in this structure, the charging roller 8 attached to the bearing 20 is pressed onto the photosensitive drum 7 by the urging force of the urging member 21 (first state).

Furthermore, in the bearing 20 a composite spring 35 constituted of the conductive member electrically contacts the urging member 21, and the bearing 20 is constituted of the conductive member. Therefore, when the charging roller 8 is attached to the bearing 20, electric conduction is enabled from the composite spring 35 to the charging roller 8.

Figure 10:
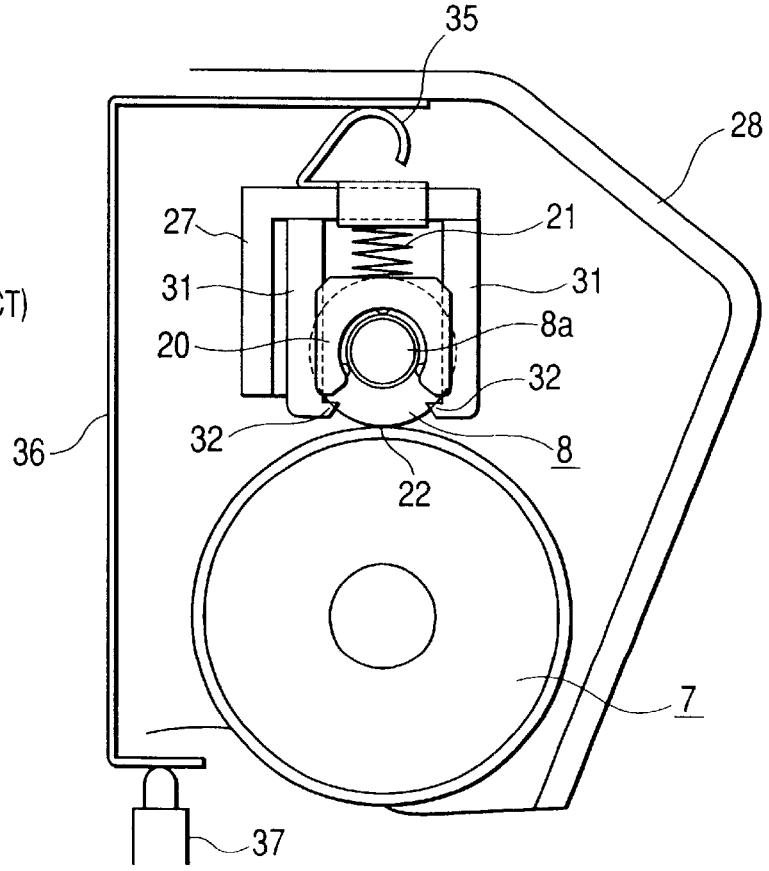
FIG. 10 is a view showing a first state in which the charging roller is placed in a predetermined pressure contact with a photosensitive drum.

During the image formation of the printer A, the holding member 27 and the cartridge frame 28 have a positional relation in the first state of FIG. 10, the charging roller 8 is brought into pressure contact with the photosensitive drum 7 by the urging force of the urging member 21, and the photosensitive drum 7 is in a chargeable state.

Moreover, a contact member 36 is extended in the cartridge member 28, one end of the contact member is in pressure contact with the compound spring 35, and the other end is in pressure contact with a contact pin 37 so that the electric conduction is enabled. The contact pin 37 is disposed on the side of the printer main body 17, and connected to a primary charging power source (not shown). Furthermore, the contact member 36 necessarily contacts the contact pin 37 when the process cartridge B is inserted in the printer main body 17.

As described above, in the first state of FIG. 10, since the primary charging power source and the charging roller 8 are in the electrically connectable state, a primary bias current can be supplied to the charging roller 8.

Figure 11:
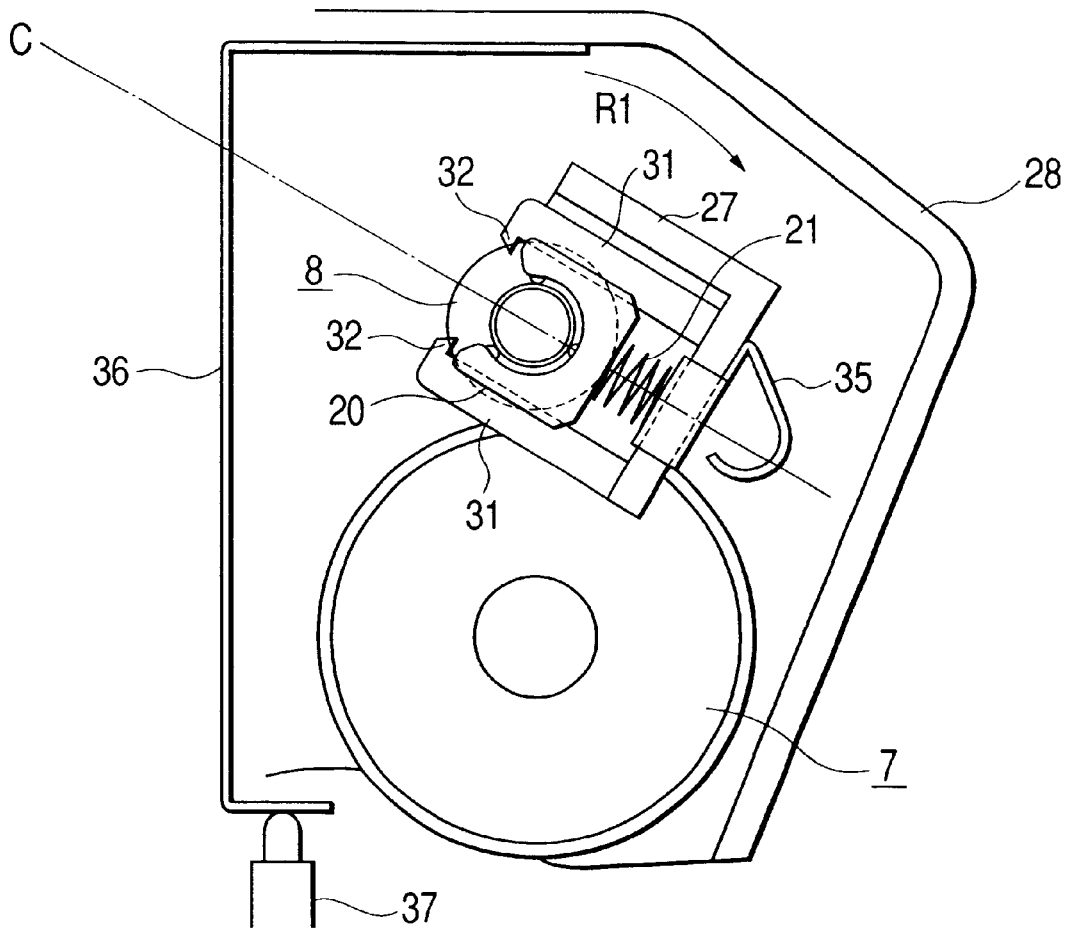
FIG. 11 is a view showing a second state in which the charging roller is held in noncontact position away from the photosensitive drum.

Subsequently, when the printer A is in a nonimage formation state, as shown in FIG. 11, by the rotation of the drive means 30 subjected to sequence on the side of the printer main body 17, the holding member 27 rotates by a given amount in a direction indicated by the arrow R1. In this case, since the member held by the holding member 27 similarly rotates, the urging direction of the urging member 21 is changed to a direction indicated by the line C from the photosensitive drum 7. Since the bearing 20 moves along the bearing guide 31, the charging roller 8 can be separated from the photosensitive drum 7 (second state). In this case, the bearing stopper 32 prevents the bearing 20 from dropping from the holding member 27.

At the same time, the compound spring 35 is separated from the contact member 36 and placed in the non image formation state. When the charging roller is separated from the photosensitive drum 7, no voltage is applied to the charging roller.

The second state of FIG. 11 is not limited to the non image formation state. In the similar packaging state of the process cartridge B, since the charging roller 8 is separated from the photosensitive drum 7 for a long period from plant shipment until operation by the user, no local fatigue deformation is generated, and the charging defect during the image formation can be prevented beforehand.

Figure 12:
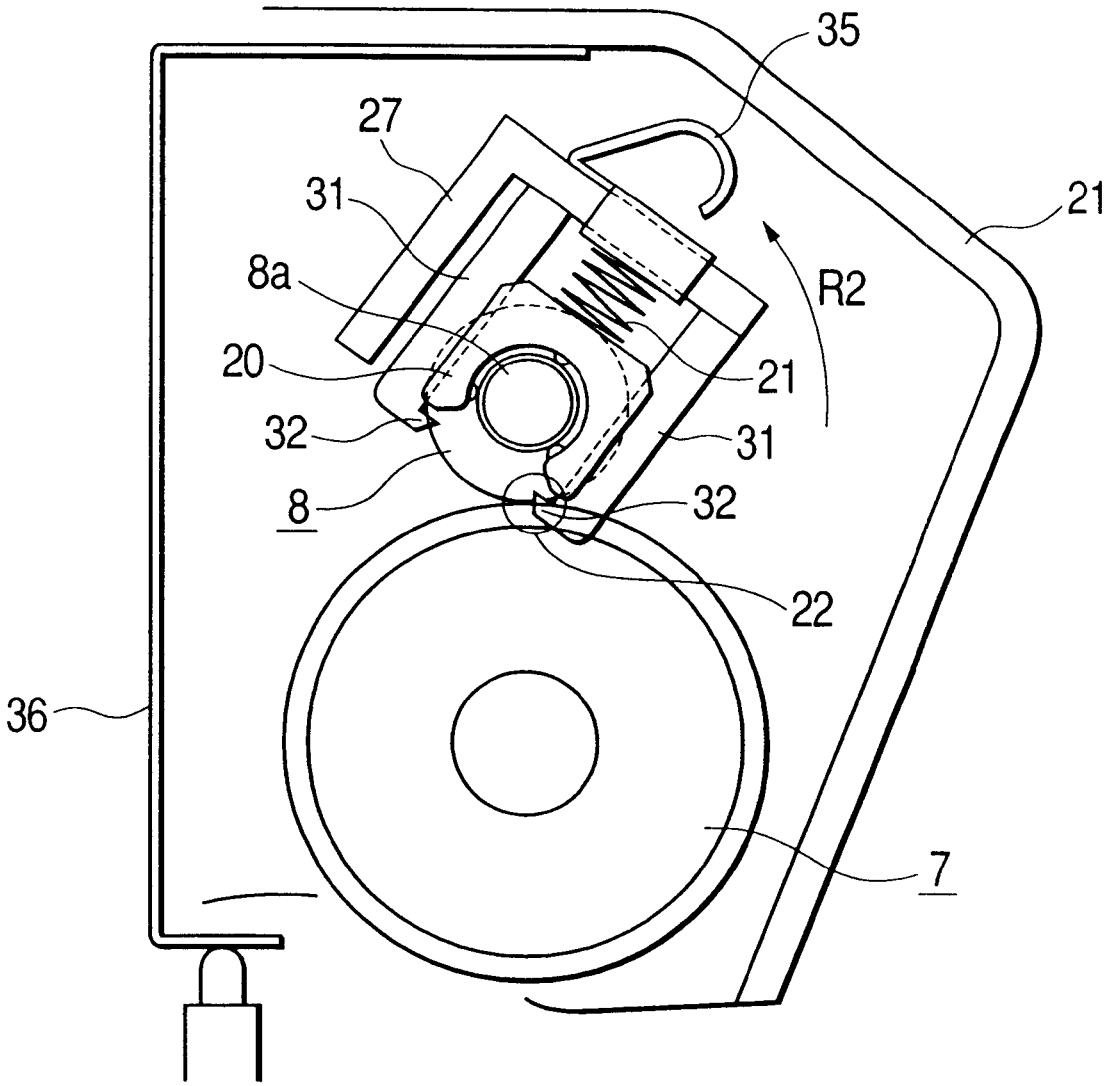
FIG. 12 is a view showing that the charging roller is in an incomplete positional state.

When the printer A again shifts from the second state of FIG. 11 to the image formation state, according to the sequence on the side of the printer main body, in reverse to the above-described, the holding member 27 is rotated in an opposite direction indicated by the arrow R2 as shown in FIG. 12, thereby trying to return to the first state position of FIG. 10 in which the charging roller 8 is in pressure contact with the photosensitive drum 7 with a predetermined pressurizing force.

However, in the process of returning from the second state of FIG. 11 to the first state of FIG. 10, since the charging roller 8 contacts the photosensitive drum 7 as shown in FIG. 12, the friction resistance of the nip portion 22 is exerted, it becomes difficult to smoothly return to the first state of FIG. 10. In the interim state of FIG. 12, although the charging roller 8 contacts the photosensitive drum 7, the compound spring 35 is out of contact with the contact member 36, so that the primary charging current cannot be supplied to the charging roller 8. In this state it cannot be said that the charging roller 8 and the compound spring 35 are in the normal position for the image formation.

Figure 13:
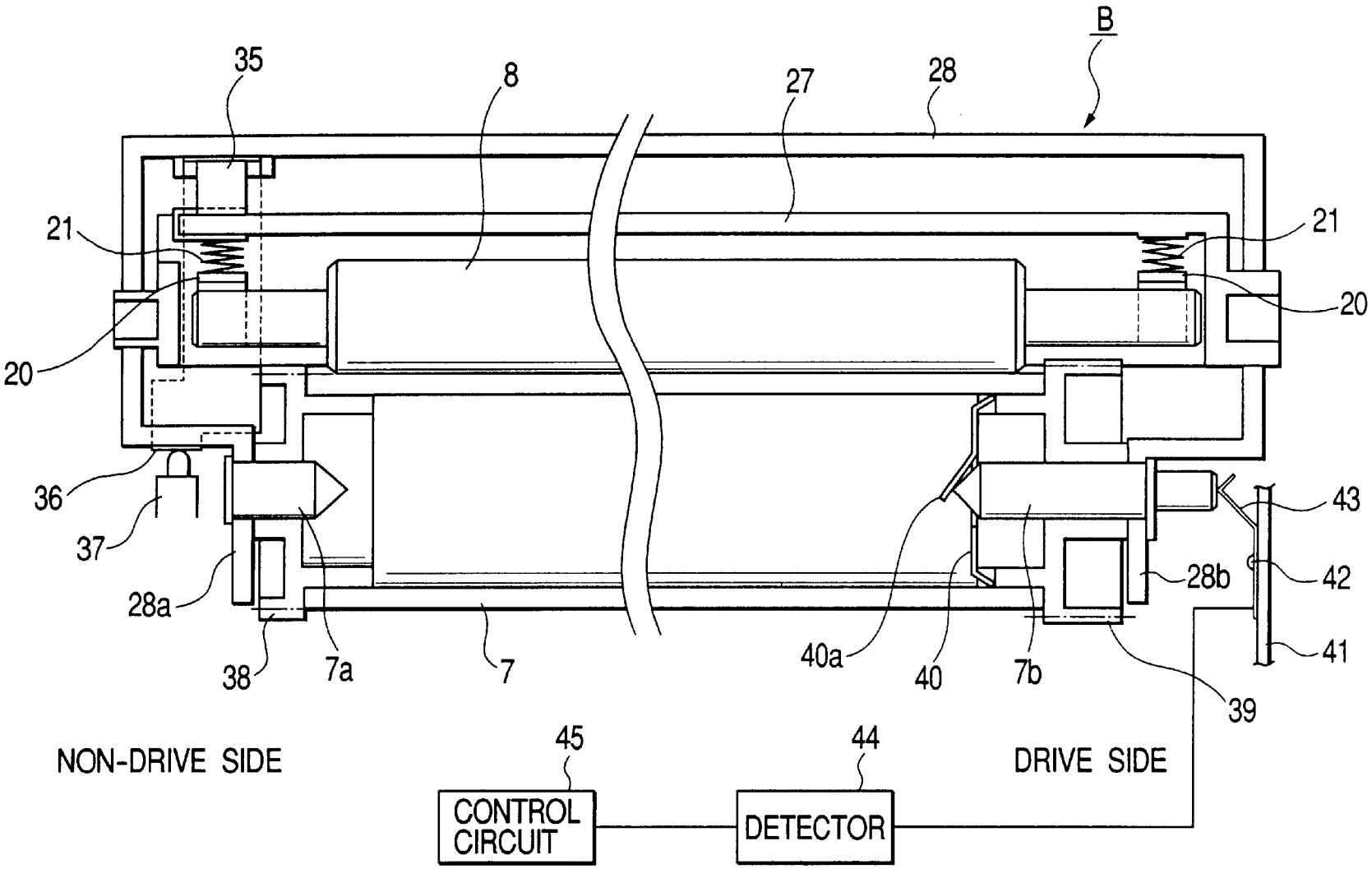
FIG. 13 is a vertical sectional view of the process cartridge mounted to a main body of the printer.

FIG. 13 is a vertical sectional view during the image formation when the process cartridge B is inserted in the printer main body 17. For the photosensitive drum 7, a drum flange 38 is fitted and fixed on a nondrive side of the photosensitive drum 7, and rotatably supported by a fixed nondrive side drum shaft 7*a*. Since the drum shaft 7*a* of the present embodiment requires no grounding, the material is not limited to a metal, and an insulating synthetic resin may be used.

Similarly, a drum flange 39 is fitted and fixed on the drive side of the photosensitive drum 7, and rotatably supported by a drum shaft 7*b*. Since the drum shaft 7*b* of the present embodiment requires the grounding, the material of the drum shaft 7*b* is limited to conductive members such as a metal.

The drum shafts 7*a*, 7*b* are fitted and fixed to side plates 28*a*, 28*b* of a cartridge member.

One end of the drum shaft 7*b* is in pressure contact with a spring portion 40*a* of an earth plate 40 disposed to abut on the inner end surface of the drum flange 39. During the image formation, since the earth plate 40 rotates with the rotation of the photosensitive drum 7, the contact point of the drum shaft 7*b* and the contact point of the spring portion 40*a* slide on each other. The earth plate 40 has a protrusion on its end, and this protrusion is slightly directed to the drive side and bites the inner surface of the photosensitive drum 7 with elasticity.

The other end of the drum shaft 7*b* is in pressure contact with the distal end of a leaf spring 43 fixed to a metal side plate 41 of the printer main body 17 via a screw 42. The leaf spring 43 is formed from conductive materials such as a spring steel, stainless, phosphor bronze, beryllium, and bronze plate.

The leaf spring 43 is connected to a detector 44 disposed on the printer main body 17. During the image formation, when the charging roller 8 and the compound spring 35 are in the normal position (first state) as shown in FIG. 10, the current applied from the primary charging power source of the printer A is correctly grounded to the side plate 41 of the printer main body via the conductive members and contact points, this earth current is read by the detector 44, an electric signal is fed back to a control circuit 45 for controlling the operation of the printer A, the control circuit 45 is allowed to recognize that the charging roller 8 is in the normal position during the image formation, the control circuit 45 judges that the image formation is enabled, and the printer A proceeds to the image forming operation.

However, in the interim state of FIG. 12, although the charging roller 8 contacts the photosensitive drum 7, the compound spring 35 does not contact the contact member 36, and the detector 44 cannot detect the earth current. In this state, the control circuit 45 judges that the charging roller 8 is not in the normal position for the image formation, thereby preventing the printer A from proceeding to the image forming operation.

If the contact point of the compound spring 35 and the contact point of the contact member 36 are omitted, and if the constitution is employed in which the primary charging current can be supplied to the charging roller 8 irrespective of the position of the charging roller 8, even for the charging roller 8 not placed in the normal position for the image formation, the control circuit 45 incorrectly judges that the charging roller 8 is in the normal position for the image formation in the contact situation of the charging roller 8 and photosensitive drum 7, possibly shifting the printer A to the image forming operation. In this state, when the urging force of the charging roller 8 to the photosensitive drum 7 is insufficient, the image defect is possibly caused by the charging defect on the surface of the photosensitive drum 7.

In the present embodiment, when the control circuit 45 judges that the charging roller 8 is not in the normal position (first state) for the image formation, the holding member 27 is further rotated by the drive means 30 until the detector 44 detects the earth current according to the sequence.

By continuing this operation, the charging roller 8 can necessarily be moved to the normal position for the image formation.

Specifically, in the present embodiment, the first state in which the charging roller 8 and the photosensitive drum 7 contact with each other, and the charging roller side electrode 35 and the printer main body side electrode 36 contact with each other, and the second state in which these components are in the non-contact state can reversibly be converted, and the conduction detector 44 is disposed in a closed circuit from the primary charging power source to the image bearing member earth to detect the first and second states of the charging roller 8.

Furthermore, since the local fatigue deformation particularly of the pressure contact surface easily occurs in the charging roller 8 using the foamed elastic materials such as Rubycell described in the cleaner-less system, the pressure contact is released not only during the long storage but also during the non image formation in the printer A. Moreover, since the states of the non image formation and image formation need to be reversibly repeated, the above-described constitution is necessary.

<Others>

1) The charging member is not limited to the charging roller.

2) The converting to the second state and the retainment of the second state in which the charging member does not contact the image bearing member are performed in at least a certain period during the non image forming process in an operation process of an image forming apparatus, and it is preferable to convert to the second state and retain this state during the apparatus main power off state, standby state, transportation, and the like.

3) In the direct charging of the image bearing member (charged member), the image bearing member preferably has a layer with a surface resistance of $10^9$ to $10^{14}\Omega\cdot$cm. An OCL photosensitive member obtained by coating the OPC photosensitive member with a surface layer (charge injection layer) with the conductive particles such as $SnO_2$ dispersed therein, a photosensitive member having a surface layer of α-Si (amorphous silicon, non-crystalline silicon), and other photosensitive members having charge injection charging properties may be used.

4) When AC voltage (alternation voltage) is included in the bias applied to the charging member and the developer bearing member, as the waveform of the AC voltage, a sine wave, a rectangular wave, a triangular wave, and the like may appropriately be used. Moreover, the rectangular wave may be formed by periodically turning on/off the direct-current power source. As described above, as the waveform of the alternation voltage, a bias whose voltage value periodically changes can be used.

5) The image exposure means for forming the electrostatic latent image is not limited to the laser scan exposure means for forming a digital latent image as in the present embodiment, and other light emitting elements such as a usual analog image exposure and LED, the combination of the light emitting element such as a fluorescent lamp and a liquid crystal shutter, and any other means that can form the electrostatic latent image in accordance with the image information can be used.

6) The image bearing member may be an electrostatic recording dielectric member. In this case, after uniformly subjecting the dielectric member surface to the primary charging of the predetermined polarity and potential, charge is selectively eliminated by charge eliminating means such as a charge eliminating needle head and an electron gun to write and form the target electrostatic latent image.

7) The developing system and means of the E-electrostatic latent image are arbitrary. Generally the method of developing the electrostatic latent image are roughly classified into four types of methods: a method comprising coating the developer bearing member with nonmagnetic toner with a blade or the like, or coating the developer bearing member with magnetic toner using a magnetic force, performing conveyance of the toner, and developing the image on the image bearing member in a non-contact state (mono-component non-contact development); a method of developing the image in a contact state (mono-component contact development); a method comprising coating the developer bearing member with a developer as a mixture of toner particles and a magnetic carrier by the magnetic force, performing conveyance of the developer, and developing the image on the image bearing member in the contact state (two-component contact development); and a method of developing the image in the non-contact state (two-component non-contact development).

8) The transfer means is not limited to the roller transfer, but belt transfer, corona discharge transfer, and the like may be used. In the image forming apparatus, the transfer drum, transfer belt, and other intermediate transfer members may be used not only to form a monochromatic image but also to form a multi-color or full-color image by multiple transfer.

9) There is also an image display in which an electrophotographic photosensitive member or an electrostatic recording dielectric member of a rotating belt type is used as the image bearing member, the toner image of the image information is formed on the image bearing member by the process means of charging and forming the electrostatic latent image and developing the image, the toner image forming section is positioned in a reading display section to display the image, and the image bearing member is repeatedly used to form the display image. Such image display is also included in the image forming apparatus of the present invention.

10) The process cartridge indicates that the image bearing member and at least one of the charging means, developing means, and cleaning means are made integrally into a cartridge (unit) and the cartridge is detachably mountable to a main body of the image forming apparatus. The process cartridge of the present invention includes at least the image bearing member and charging means.

The embodiments of the present invention have been described above, but the present invention is not limited to these embodiments, and can variously be modified.

What is claimed is:

1. A charging device for charging a member to be charged, comprising:

a charging member for contacting the member to be charged to charge the member to be charged;

contact-separation means for contacting said charging member to said member to be charged and separating said charging member from said member to be charged; and power supply means provided with an openable power supply path for supplying electric power to said charging member, said power supply means being constituted so that when said charging member is in contact with said member to be charged, the power supply path is closed, and whensaid charging member is out of contact with said member to be charged, the power supply path is opened.

2. The charging device according to claim 1, further comprising check means for checking a conduction state of the power supply path.

3. The charging device according to claim 2, wherein when said check means judges that said power supply path is opened, said charging device does not perform a charging operation.

4. The charging device according to claim 2, wherein when said check means judges that said power supply path is opened, said contact-separation means performs a contact operation of said charging member.

5. The charging device according to claim 4, wherein the contact operation of said charging member by said contact-separation means is performed until said check means judges that said power supply path is closed.

6. The charging device according to claim 1, wherein said charging device is used in an image forming apparatus, and said member to be charged is an image bearing member for bearing a toner image.

7. The charging device according to claim 6, wherein said contact-separation means brings said charging member into contact with said image bearing member on an image formation, and separates said charging member from said image bearing member on a nonimage formation.

8. The charging device according to claim 6, wherein said charging member and said image bearing member are constituted as one unit which is detachably mountable to said image forming apparatus.

* * * * *

UNITED STATES PATENT AND TRADEMARK OFFICE

CERTIFICATE OF CORRECTION

PATENT NO. : 6,311,030 B1
DATED : October 30, 2001
INVENTOR(S) : Ichiro Terada

It is certified that error appears in the above-identified patent and that said Letters Patent is hereby corrected as shown below:

Column 2,
Line 41, "Further" should read -- A further --;
Line 57, "As" should read -- is --;
Line 61, "an" should read -- an appearance --;
Line 63, "an" should read -- a --; and
Line 65, "o" should read -- to --.

Column 3,
Line 31, "an" should read -- an appearance --.

Column 5,
Line 12, "advances" should read -- advance --.

Column 8,
Line 35, "compound" should read -- composite --;
Line 60, "compound" should read -- composite --;
Line 61, "non image" should read -- nonimage --; and
Line 65, "non image" should read -- nonimage --.

Column 9,
Line 20, "compound" should read -- composite --;
Line 24, "compound" should read -- composite --; and
Line 61, "compound" should read -- composite --.

Column 10,
Line 8, "compound" should read -- composite --;
Line 14, "compound" should read -- composite --;
Line 51, "non image" should read -- nonimage --;
Line 52, "non image" should read -- nonimage --; and
Line 61, "non image" should read -- nonimage --.

Column 11,
Line 35, "E-electrostatic" should read -- electrostatic --.

UNITED STATES PATENT AND TRADEMARK OFFICE

CERTIFICATE OF CORRECTION

PATENT NO. : 6,311,030 B1
DATED : October 30, 2001
INVENTOR(S) : Ichiro Terada

It is certified that error appears in the above-identified patent and that said Letters Patent is hereby corrected as shown below:

Column 12,
Line 33, "whensaid" should read -- when said --; and
Line 57, "on" should read -- in --.

Signed and Sealed this

Twenty-third Day of April, 2002

*Attest:*

*Attesting Officer*

JAMES E. ROGAN
*Director of the United States Patent and Trademark Office*